US009615630B2

(12) United States Patent
Jackson

(10) Patent No.: US 9,615,630 B2
(45) Date of Patent: Apr. 11, 2017

(54) SHOE SOLE ADJUSTMENT PAD

(71) Applicant: Shantel Christine Jackson, Opa-Locka, FL (US)

(72) Inventor: Shantel Christine Jackson, Opa-Locka, FL (US)

( * ) Notice: Subject to any disclaimer, the term of this patent is extended or adjusted under 35 U.S.C. 154(b) by 242 days.

(21) Appl. No.: 14/282,668

(22) Filed: May 20, 2014

(65) Prior Publication Data

US 2015/0335102 A1 Nov. 26, 2015

(51) Int. Cl.

| | |
|---|---|
| ***A43D 86/00*** | (2006.01) |
| ***A43B 9/14*** | (2006.01) |
| ***A43B 13/37*** | (2006.01) |
| ***A43B 7/14*** | (2006.01) |
| ***A43B 13/14*** | (2006.01) |
| ***A43B 21/00*** | (2006.01) |

(52) U.S. Cl.

CPC ..... *A43D 86/00* (2013.01); *A43B 7/1425* (2013.01); *A43B 7/1445* (2013.01); *A43B 9/14* (2013.01); *A43B 13/145* (2013.01); *A43B 13/37* (2013.01); *A43B 21/00* (2013.01)

(58) Field of Classification Search

CPC .. A43B 13/37; A43B 3/20; A43B 9/14; A43D 86/00

USPC ..... 36/15, 71, 19.5, 24.5; 12/142 J, 142 T, 12/142 F

See application file for complete search history.

(56) References Cited

U.S. PATENT DOCUMENTS

| | | | | | |
|---|---|---|---|---|---|
| 980,173 | A | * | 12/1910 | Clark | A43B 3/20 36/15 |
| 1,187,518 | A | * | 6/1916 | Frost et al. | A43B 13/36 36/15 |
| 1,714,943 | A | * | 5/1929 | Brockman | A43B 13/32 12/142 F |
| 1,779,671 | A | * | 10/1930 | Hoyer | A43B 13/28 206/37 |
| 2,128,134 | A | * | 8/1938 | Giusto | A43C 15/00 36/15 |
| 2,191,442 | A | * | 2/1940 | Cavey | A43B 3/20 36/19.5 |
| 2,547,480 | A | * | 4/1951 | McDaniel | A43B 13/00 36/19 R |
| 2,747,302 | A | | 5/1956 | Heisterkamp | |
| 2,937,462 | A | * | 5/1960 | Hack | A43B 13/223 36/149 |
| 3,742,627 | A | * | 7/1973 | Schneider | A43B 7/142 36/28 |

(Continued)

FOREIGN PATENT DOCUMENTS

| | | |
|---|---|---|
| GB | 1115505 | 5/1968 |
| GB | 2490123 | 10/2012 |

*Primary Examiner* — Marie Bays

(74) *Attorney, Agent, or Firm* — Glenn E. Gold, P.A.; Glenn E. Gold

(57) ABSTRACT

A method for modifying a high heel shoe to reduce the angulation of the wearer's foot includes obtaining an external pad defining an outer contour and having a top surface, the external pad being at least as large as the area of the toe region outsole that contacts the ground when a wearer walks and having a thickness within the range of one half inch to two inches. The toe region of the shoe outsole is cleaned and the external pad is affixed to the toe region of the shoe outsole. The outer contour of the external pad is trimmed to conform to the outer contour of the outsole.

17 Claims, 8 Drawing Sheets

(56) References Cited

U.S. PATENT DOCUMENTS 4,246,706 A * 1/1981 Persons, Jr. ..... A43C 13/00 36/71.5
4,429,473 A 2/1984 Blumenstein
4,445,285 A * 5/1984 Phillips ..... A43B 13/146 36/25 R
4,848,008 A 7/1989 Kuehnle et al.
4,979,318 A 12/1990 Cohen
5,782,015 A 7/1998 Dananberg
6,412,198 B1 7/2002 Rothbart
7,216,443 B2 5/2007 Baden et al.
7,398,608 B2 7/2008 Schoenborn
7,962,986 B2 6/2011 Dananberg
2003/0115778 A1* 6/2003 McKissic ..... A43B 5/001 36/127
2003/0159314 A1* 8/2003 Lewia ..... A43B 1/0081 36/130
2005/0188563 A1* 9/2005 McKissic ..... A43B 5/001 36/15
2005/0252043 A1* 11/2005 Blackwell ..... A43B 1/0036 36/134
2005/0274043 A1* 12/2005 DeSaix ..... A43B 1/0027 36/59 R
2006/0053660 A1* 3/2006 Lewton ..... A43B 7/1445 36/59 R
2007/0256330 A1 11/2007 Wallin et al.
2010/0122473 A1* 5/2010 Santos ..... A43B 13/36 36/100
2010/0146816 A1 6/2010 Cappaert et al.
2011/0047815 A1* 3/2011 Asquith ..... A43B 17/105 36/15
2012/0137530 A1 6/2012 Yun
2013/0042422 A1* 2/2013 Neal ..... A43B 1/0072 12/103
2015/0335102 A1* 11/2015 Jackson ..... A43B 7/30 12/142 R
2016/0095386 A1* 4/2016 Macfarlane ..... A43B 13/36 36/15

* cited by examiner

SHOE SOLE ADJUSTMENT PAD

FIELD OF THE INVENTION

The present disclosure generally relates to apparatuses and methods for modifying high-heeled shoes. More particularly, the present disclosure relates to a sole adjustment pad applied to the sole of a woman's high heel shoe to provide cushioning and to change the tilt angle of the shoe for additional comfort, and the corresponding method of use.

BACKGROUND OF THE INVENTION

Since the mid-twentieth century high-heeled footwear for women has fallen in and out of popular fashion trend several times, most notably in the 1990's, when lower heels and even flats predominated. Lower heels gave way to higher heels, and the shape of the heel itself has gone through a number of fashionable iterations. Today, high heels are typically worn with heights varying from a "kitten heel" of 1.5 inches to a "stiletto heel" of 4.0 inches or more. Extremely high-heeled shoes, such as those higher than 5.0 inches, are normally worn only for aesthetic reasons, but are not considered practical. High heels have seen significant controversy in the medical field, with many podiatrists seeing patients whose severe foot problems have been caused almost exclusively by high-heeled footwear.

While many women choose to wear high-heeled shoes for a various aesthetic reasons—such as accentuating the appearance of the calves to make the wearer's posture and gait more seductive, appearance taller, legs longer and feet smaller—there are myriad reasons that high heeled shoes should not be worn, almost exclusively related to health and practicality. For example, high heels can cause foot and tendon pain and increase the likelihood of sprains and fractures. They can make a woman's calves appear more rigid and sinewy. High heels can create foot deformities such as hammertoes and bunions and can cause lower back pain. Altered forces at the wearer's knee caused by walking in high heels may predispose a wearer to degenerative changes in the knee joint. Frequent wearing of high heels results in a higher incidence of degenerative joint disease of the knees. This is because they cause a decrease in the normal rotation of the foot, which puts more rotation stress on the knee.

High-heeled shoes slant the foot forward and downward, while bending the toes up. The more that the feet are forced into this position, the more it may cause portions of the calf muscle to shorten. This may cause problems when the wearer chooses lower heels or flat-soled shoes. When the foot slants forward, a much greater weight is transferred to the ball of the foot and the toes, thereby increasing the likelihood of damage to the underlying soft tissue that supports the foot. In many shoes, style dictates function, either compressing the toes or forcing them together, possibly resulting in blisters, corns, hammer toes, bunions, plantar fasciitis and many other medical conditions, most of which are permanent and require surgery to alleviate the pain. High heels, because they tip the foot forward, put pressure on the lower back by making the wearer's rump push outwards, crushing the lower back vertebrae and contracting the muscles of the lower back.

Despite the medical issues surrounding high-heel wear, a few podiatrists recommend well-constructed low-to-moderate heels for some patients. A slight elevation of the heel improves the angle of contact between the metatarsals and the horizontal plane, thereby more closely approximating the proper angle and resulting in proper weight distribution of a medium-to-high-arched foot. Other foot specialists, however, argue that any heel causes unnecessary stresses on the various bones and joints of the foot.

However, the popularity of high-heels for wear by women remains popular and the cost of replacing a wardrobe of high-heels with low heels is relatively prohibitive. Therefore, a method of modifying existing high-heeled shoes is needed to provide cushioning and reduce the angulation of the wearer's foot to alleviate discomfort and to maintain the wearer's foot at an angle less likely to cause medical issues.

SUMMARY OF THE INVENTION

The present disclosure is generally directed to a method for modifying a high heel shoe to reduce an impact force on a wearer's foot. The method includes obtaining an external pad defining an outer contour and having a top surface and wherein the external pad is made of a resilient material. The external pad is at least as large as the area of the toe region outsole that contacts the ground when a wearer walks. The toe region of the shoe outsole is cleaned. Adhesive is applied to at least one surface selected from the group consisting of the top surface of the external pad and the toe region outsole of the shoe. The top surface of the external pad is affixed to the shoe outsole, and the outer contour of the external pad is trimmed to conform to the outer contour of the outsole.

In another aspect, the external pad has a thickness within the range of one-quarter (¼) to two (2.0) inches.

In still another aspect, the external pad has a thickness of three-quarters (0.75) inches.

In yet another aspect, the external pad is constructed of one of the materials selected from the group of rubber, high density foam, polymer, and gel.

In a still further aspect, the external pad is constructed of a combination of at least two of the materials selected from the group of rubber, high density foam, polymer, and gel.

In another aspect, the external pad is substantially planar.

In another aspect, the external pad is arcuately curved.

In a still further aspect, the method includes after the cleaning step the step of abrading the toe region of the shoe outsole.

In yet another aspect, the applying step comprises applying adhesive to the top surface of the external pad and to the toe region outsole of the shoe.

In another aspect, a method for modifying a high heel shoe to reduce an impact force on a wearer's foot includes obtaining an external pad defining an outer contour and having a top surface, the external pad being at least as large as the area of the toe region outsole that contacts the ground when a wearer walks and having a thickness within the range of one half inch to two inches. The toe region of the shoe outsole is cleaned and the external pad is affixed to the toe region of the shoe outsole. The outer contour of the external pad is trimmed to conform to the outer contour of the outsole.

In still another aspect, a method for modifying a high heel shoe to reduce an impact force on a wearer's foot includes obtaining an external pad constructed of one of the materials selected from the group of rubber, high density foam, polymer, and gel. The external pad defines an outer contour and has a top surface and is at least as large as the area of the toe region outsole that contacts the ground when a wearer walks. The pad has a thickness within the range of one half inch to two inches. The toe region of the shoe outsole is cleaned and is then abraded. Adhesive is applied to at least one surface selected from the group consisting of the top surface of the external pad and the toe region outsole of the shoe. The top surface of the external pad is then affixed to the shoe outsole, and the outer contour of the external pad is trimmed to conform to the outer contour of the outsole.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
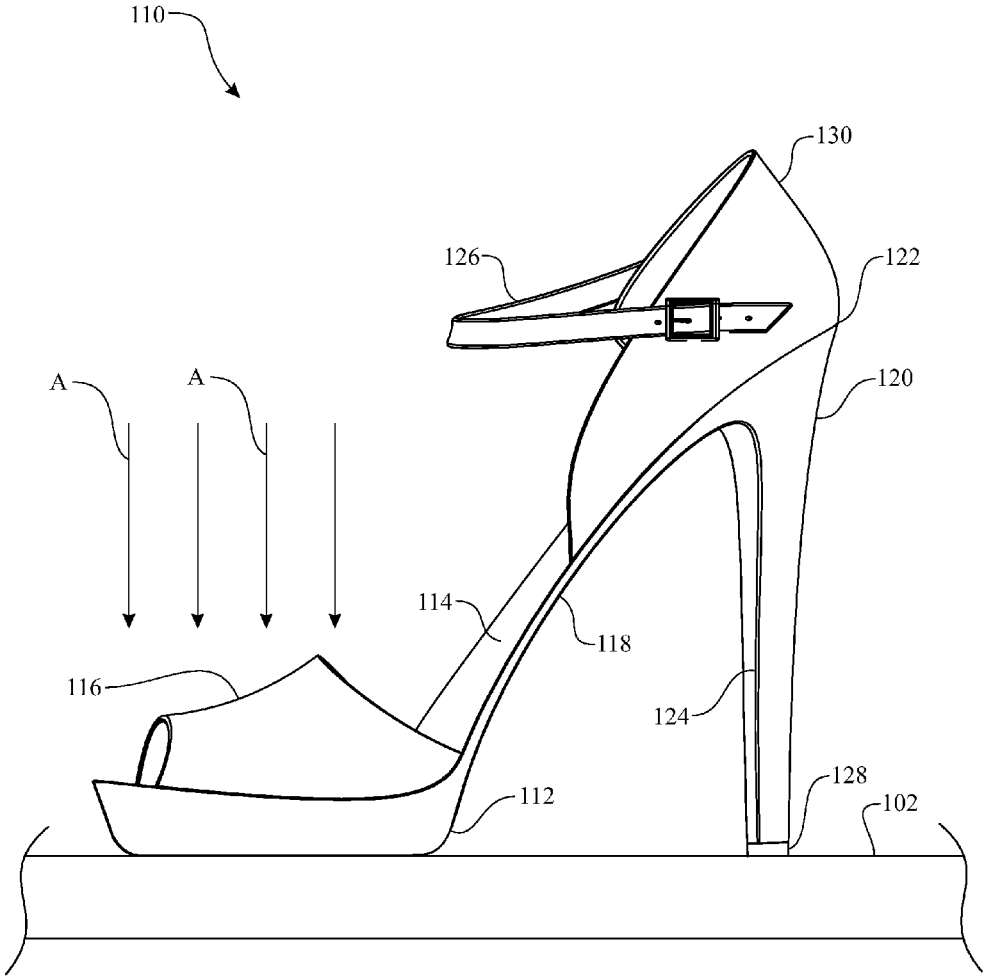
FIG. 1 (Prior Art)
FIG. 1 presents a side elevation view of a prior art woman's high heel shoe having a flat outsole.

A typical women's high-heeled shoe 110 is shown in FIG. 1, wherein the shoe 110 includes a substantially planar outsole 112 at the toe region of the shoe, which contacts the surface 102 on which a user walks. The outsole is constructed of a material having properties which provide grip, durability and water resistance. Typical materials include leather, rubber, or a synthetic rubberlike material such as those derived from petroleum based resins. The outsole 112 of high heel shoe 110 extends from the ball of the wearer's foot to the wearer's toes and is typically covered by a vamp 116. A shank 118 constructed of a high strength rigid material, such as metal, for example, extends the length of the shoe to provide the shape to the lower portion of the shoe and provide a rigid structure for supporting the wearer's foot. An insole 114 covers the top portion of the shank 118 to provide a comfortable surface for the wearer's foot to contact while wearing the shoe 110.

A quarter 130 surrounds the wearer's heel and can have a strap 126 which is fastened around the wearer's foot proximate to the wearer's ankle joint to ensure that the shoe 110 is secured to the wearer's foot. A heel 120 joins the rear portion of the shoe 110 at the counter 122 and supports the rear portion of the shoe 110. A top piece 128 at the bottom of the heel 120 contacts the surface 102 on which the wearer walks. The top piece 128 is typically formed of a hard material to provide durability to the heel 120. The forward facing part of the heel 120 is known as the heel breast 124.

As illustrated, the heel 120 of high heel shoe 110 elevates the wearer's heel significantly higher than the wearer's toes. As the height of the heel 120 increases, the slope of the shank 118 correspondingly increases and the wearer's weight, as designated by arrows "A," is increasingly supported by the ball and toes of the wearer's foot.

Figure 2:
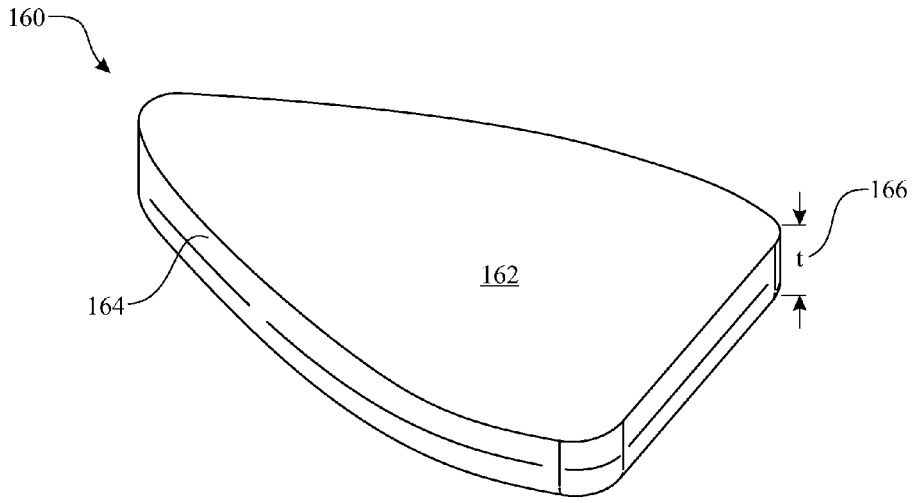
FIG. 2 presents a top right isometric view of a flat external shoe pad according to the present invention.

Referring primarily to FIG. 2, in an exemplary implementation of the invention, the various components of an external pad 160 are shown, including an outer contour 164 larger than, but generally conforming to, the outer contour of the toe portion of the outsole 112 of high heel shoe 110. The external pad 160 includes a planar top surface 162 to conform to the planar bottom surface of the outsole 112 of the toe portion of the shoe 110 and has a thickness (t) represented by reference numeral 166. The thickness (t) 166 is preferably about one-quarter (0.25) inches; however, the thickness (t) 166 can range from 0.25 to 2.0 inches, depending on how much height a wearer wishes to add to the toe portion of the high-heeled shoe 110. The external pad 160 is typically formed from rubber, high density foam, polymer, gel or a combination of two or more of these materials.

Figure 4:
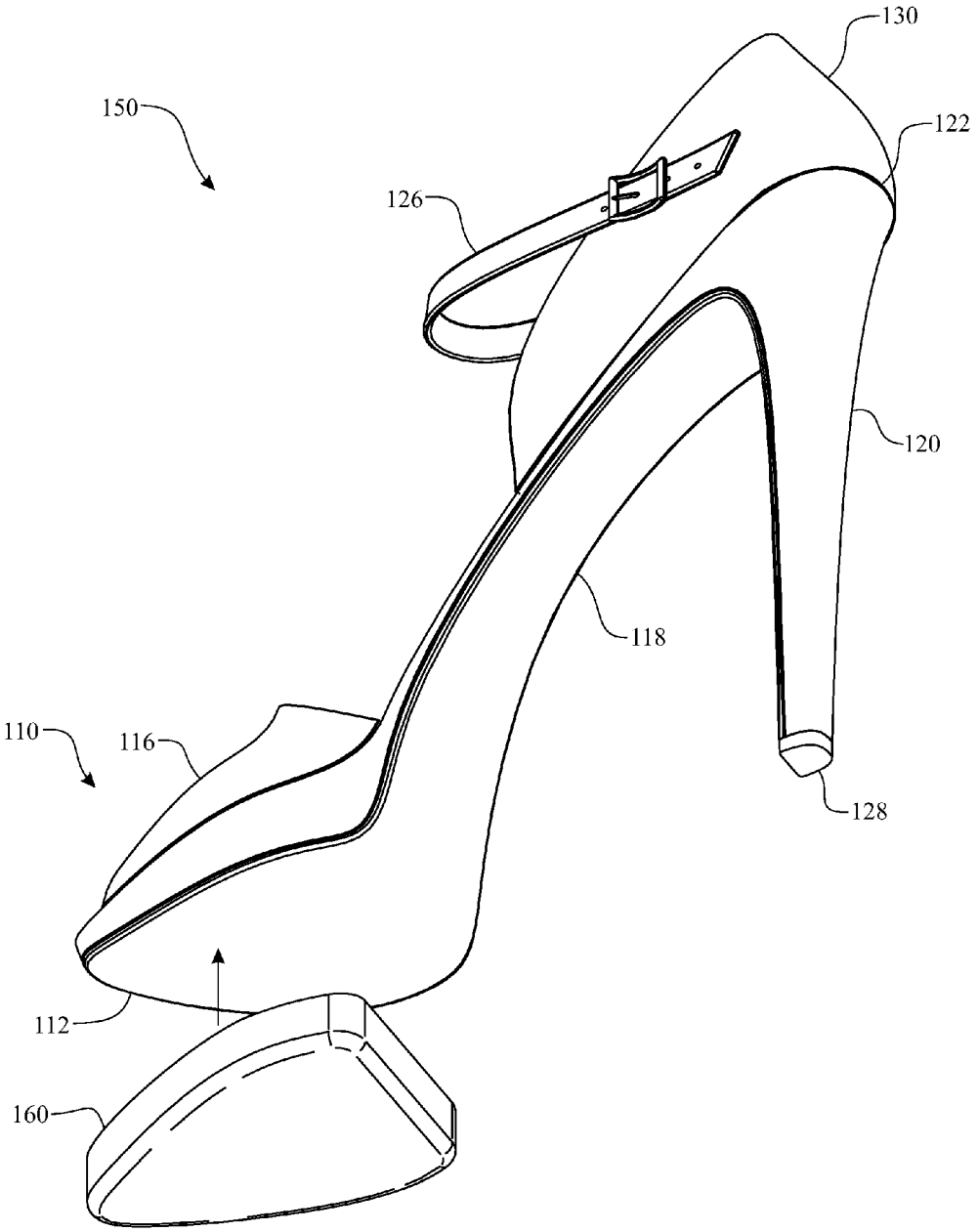
FIG. 4 presents an exploded bottom isometric view of the flat external shoe pad of FIG. 2 being applied to a woman's high heel shoe.
Figure 5:
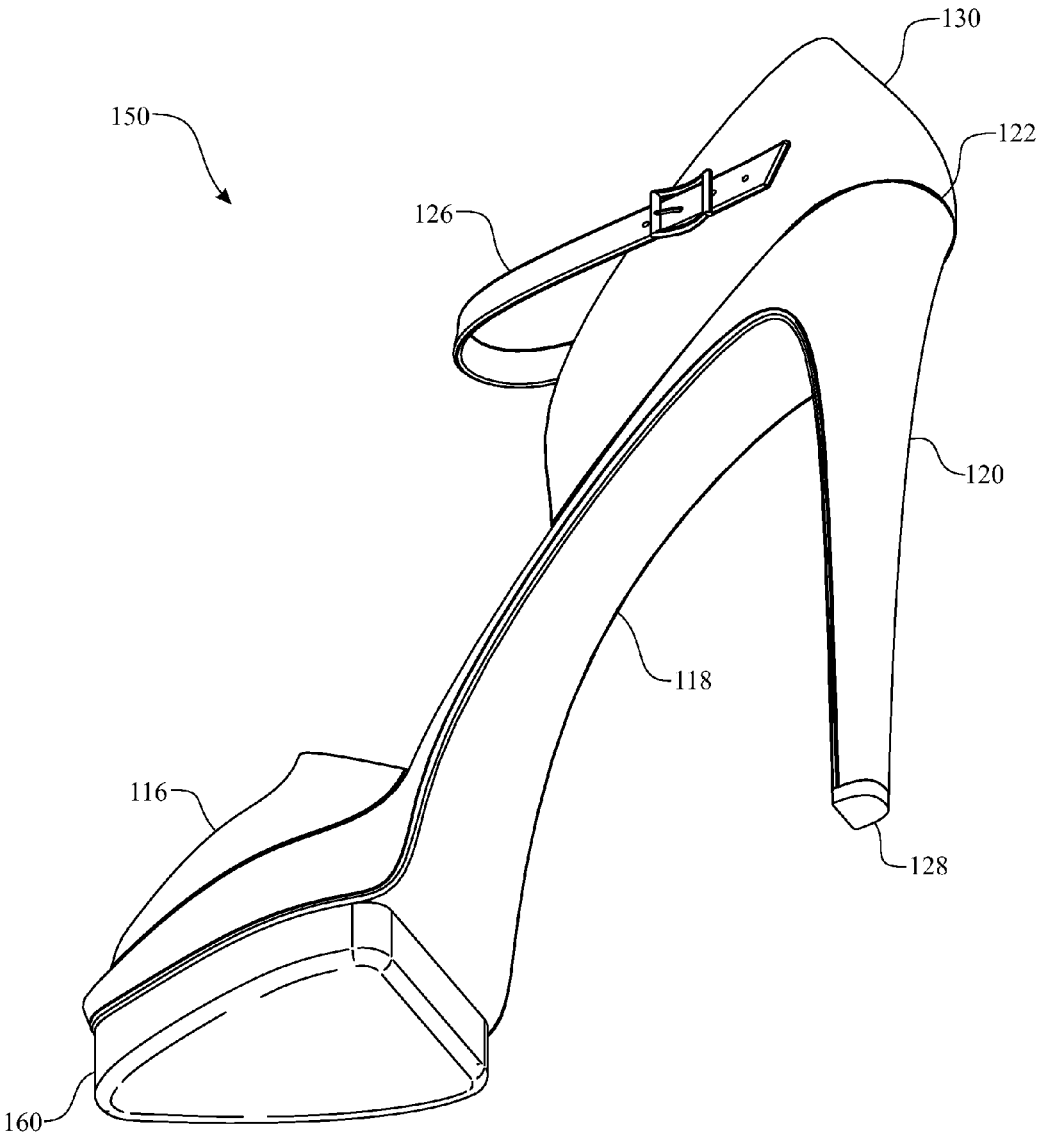
FIG. 5 presents a bottom isometric view of the external shoe pad of FIG. 2 affixed to the outsole of a woman's high heel shoe.
Figure 6:
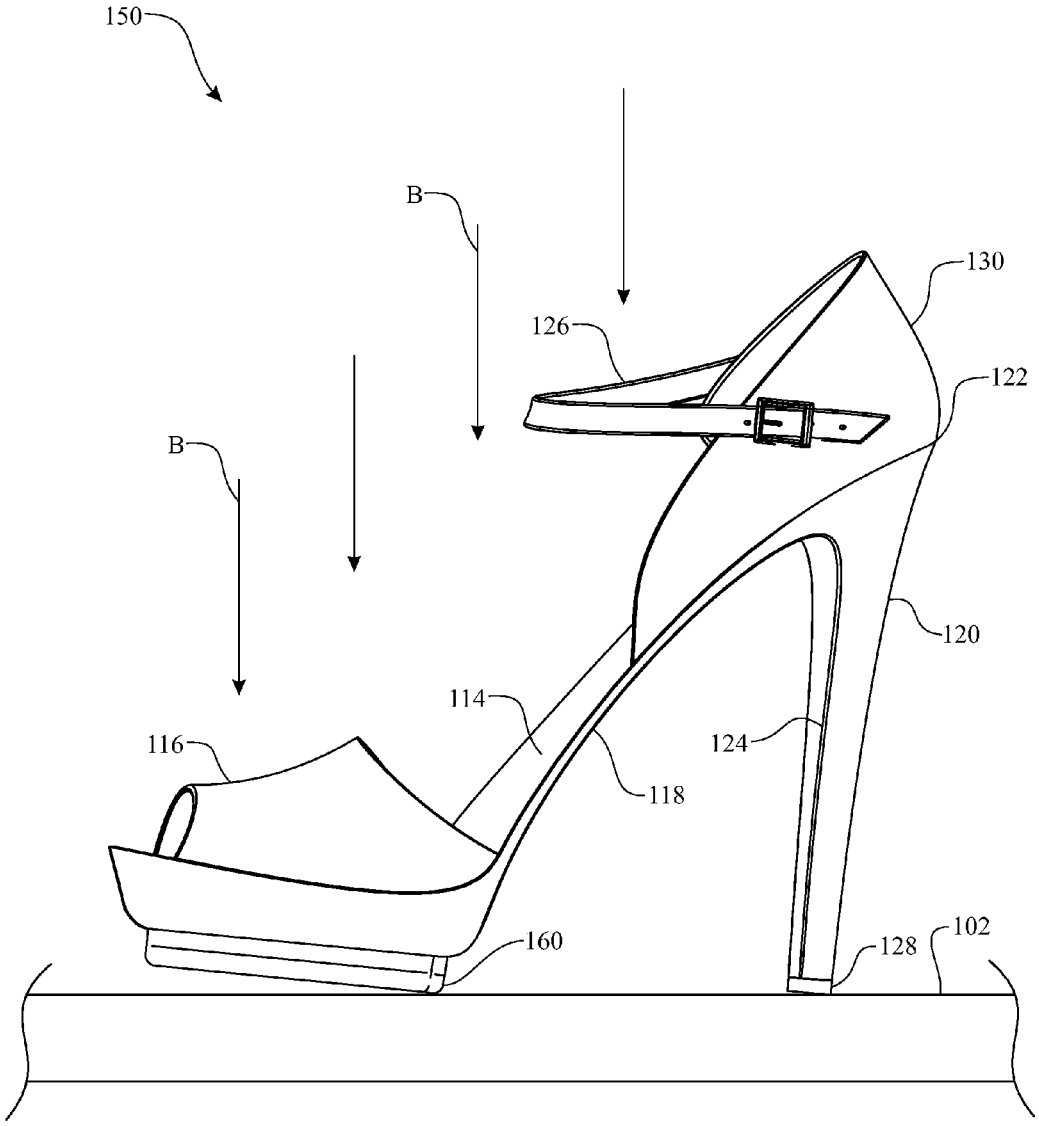
FIG. 6 presents a side elevation view of the modified woman's high heel shoe of FIG. 5 illustrating the reduced angle of the shank and redistributed weight born by the modified shoe.

As best shown in FIGS. 4-6, the high-heeled shoe 110 is modified by affixing the external pad 160 to the bottom of the toe portion of the outsole 112. The outsole 112 is cleaned of dust, dirt, or other particulates that the outsole 112 may have accumulated during prior wear. Once the outsole 112 has been cleaned, the surface of the outsole can be abraded by known methods to expose a fresh layer. A curable adhesive is applied to the exposed surface of the outsole 112 and to the top surface 162 of the external pad 160. The top surface 162 of the external pad 160 is then mated to the toe portion of the outsole 112. The adhesive is allowed a time period to cure according to common practice for the type of adhesive utilized. After the adhesive is cured, prior to securing the external pad 160 to the high-heeled shoe 110, the contour 164 is trimmed, using methods known in the shoe industry, to conform the external pad 160 to the outer contour of the outsole 112 to result in the modified shoe 150, as illustrated in FIG. 5.

In use and as best shown in FIG. 6, the modified shoe 150, when worn by a user, is supported by the surface 102. The addition of the external pad 160 to the toe portion of modified shoe 150 raises the toe and ball area of the wearer's foot by the thickness 166 (FIG. 2) of the external pad 160. Raising the toe and ball area of the wearer's foot, while maintaining the original configuration of the heel 120, reduces the angular slope of the shank 118 of the modified shoe 150. The reduction of the angular slope of the shank 118, in turn, redistributes the force concentration of the wearer's weight such that it is distributed along the length of the wearer's foot as shown by arrows labeled "B," thereby relieving a portion of the stress on the ball and toe area of the wearer's foot, typified by the stress induced by the unmodified shoe 110 shown by arrows labeled "A" (FIG. 1). Furthermore, material properties of the external pad 160, such as resilience, provide cushioning to absorb a portion of the impact force of the wearer's weight on the toe and ball area while walking, thereby providing additional comfort to the wearer while walking.

Figure 7:
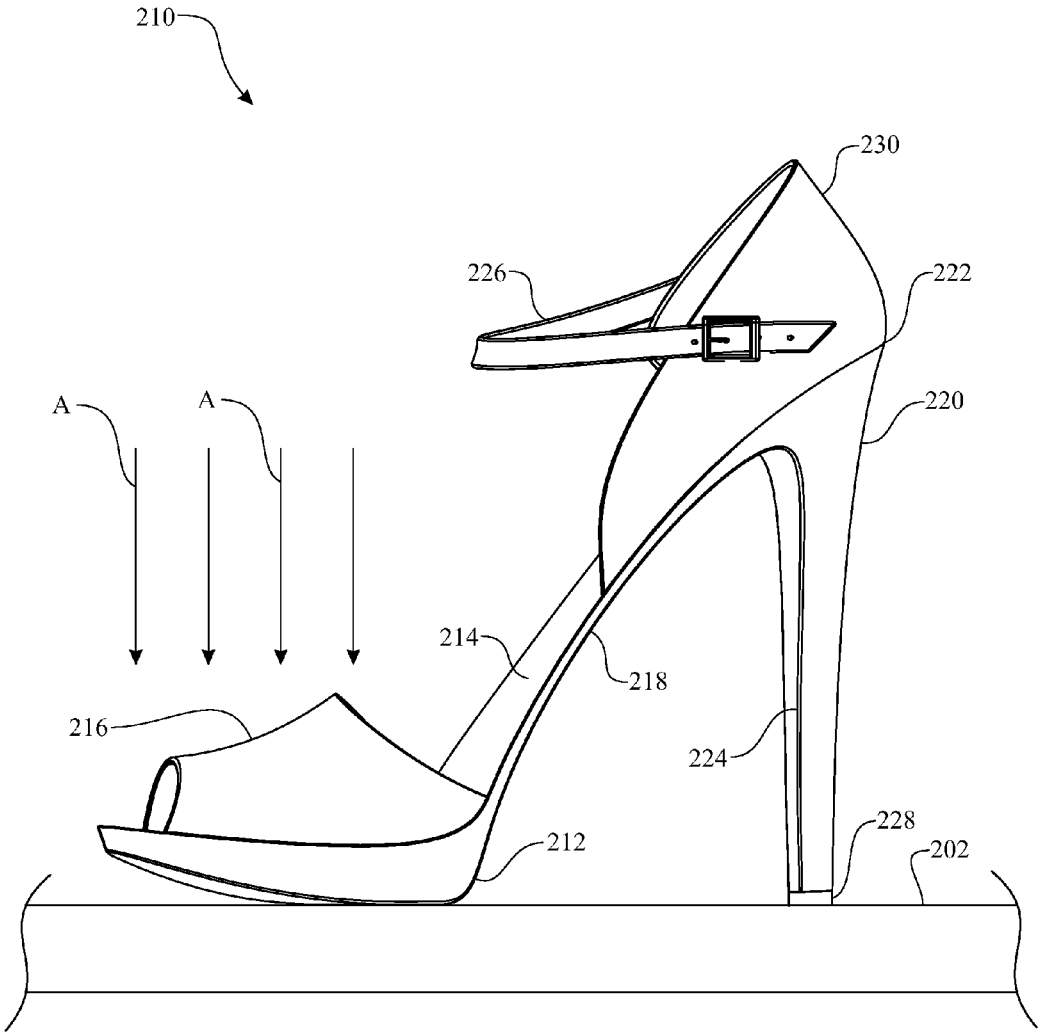
FIG. 7 (Prior Art)
FIG. 7 presents a side elevation view of a prior art woman's high heel shoe having a curved outsole.

Referring now to FIG. 7, in another implementation a women's high-heeled shoe 210 includes an arcuate, or curved, outsole 212 at the toe region of the shoe 210, a portion of which contacts the surface 202 on which a user walks. The outsole 212 is constructed from a material having properties that provide grip, durability and water resistance. Typical materials include leather, rubber, or a synthetic rubberlike material such as those derived from petroleum based resins. The outsole 212 of high heel shoe 210 extends from the ball of the wearer's foot to the wearer's toes, and is typically covered by a vamp 216. A shank 218 constructed of a high strength rigid material, such as metal, extends the length of the shoe to shape the lower portion of the shoe and provide a rigid structure for supporting the wearer's foot. An insole 214 covers the top portion of the shank 218 to provide a comfortable surface for the wearer's foot to contact while wearing the shoe 210.

A quarter 230 surrounds the wearer's heel and can have a strap 226 fastened around the wearer's foot proximate the ankle joint to ensure that the shoe 210 is secured to the wearer's foot. A heel 220 joins the rear portion of the shoe 210 at the counter 222 and supports the rear portion of the shoe 210. A top piece 228 at the bottom of the heel 220 contacts the surface 202 on which the wearer walks. The top piece 228 is typically formed of a rigid material to provide durability to the heel 220. The forward-facing part of the heel 220 is known as the heel breast 224.

As illustrated, the heel 220 of high-heeled shoe 210 elevates the wearer's heel significantly relative to the toes. As the height of the heel 220 is increased, the slope of the shank 218 correspondingly increases and the wearer's weight, as designated by arrows "A," is increasingly supported by the ball and toes of the wearer's foot.

Figure 3:
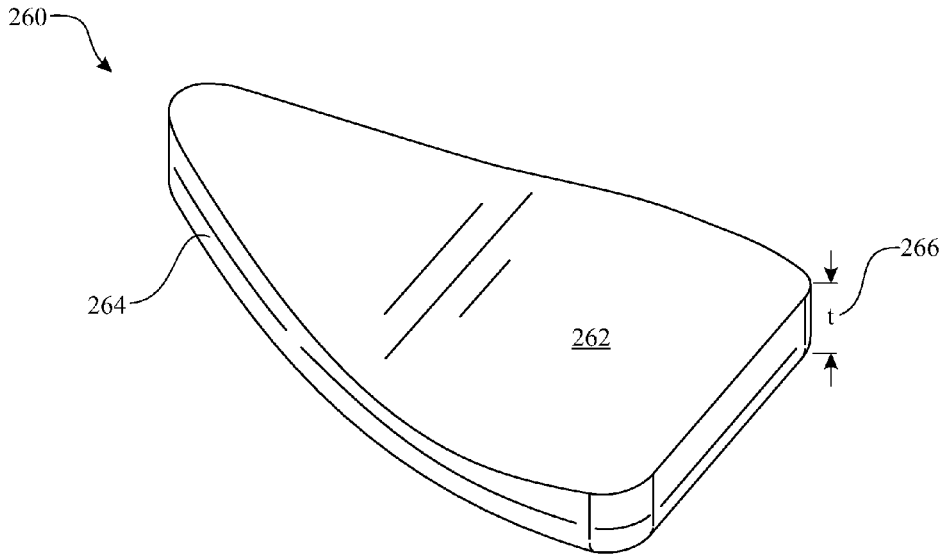
FIG. 3 presents a top right isometric view of a curved external shoe pad according to the present invention.

Referring now to FIG. 3, in another exemplary implementation, an external pad 260 is provided having an outer contour 264 larger than, but generally conforming to, the outer contour of the toe portion of the outsole 212 of high-heeled shoe 210, as shown in FIG. 7. The external pad 260 includes an arcuate, or curved, top surface 262 to conform to the curvature of the outsole 212 of the toe portion of the shoe 210, having a thickness (t) represented by reference numeral 266. The thickness (t) is generally preferably about one-quarter (0.25) inches; however, the thickness can range from 0.25 inch to 1.5 inches (or more), depending on how much height a wearer wishes to add to the toe portion of the shoe 210. The external pad is typically formed from rubber, high density foam, polymer, gel or a combination of two or more of these materials.

Figure 8:
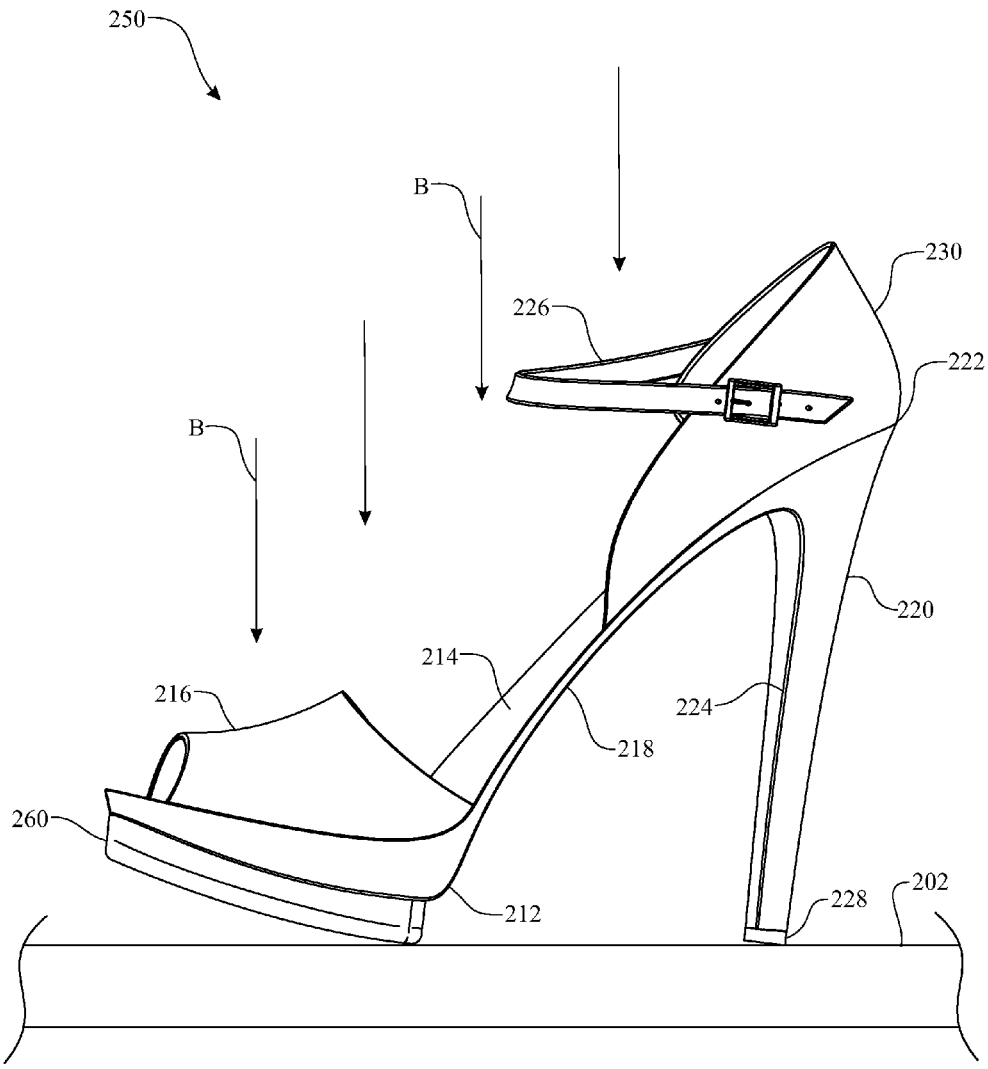
FIG. 8 presents a side elevation view of the modified woman's high heel shoe of FIG. 7 illustrating the reduced angle of the shank and redistributed weight born by the modified shoe.

As best shown in FIG. 8, shoe 210 is modified by affixing the external pad 260 to the bottom of the toe portion of the outsole 212. The outsole 212 is cleaned of dust, dirt and other particulates that the outsole 212 may have accumulated during prior wear. Once the outsole 212 has been cleaned, the surface of the outsole can be abraded by known methods to expose a fresh layer. A curable adhesive is applied to the exposed surface of the outsole 212 and to the top surface 262 of the external pad 260. The top surface 262 of the external pad 260 is then mated to the toe portion of the outsole 212. The adhesive is allowed to cure for a specified period of time according to common practice for the type of adhesive utilized. After the adhesive is cured, and prior to securing the external pad 260 to the high heel shoe 210, the contour 264 is trimmed using methods known in the shoe industry, to conform the external pad 260 to the outer contour of the outsole 212; thereby, resulting in modified shoe 250.

As best shown in FIG. 8, during use the modified shoe 250, while worn by a user, is supported by a surface 202. The addition of the external pad 260 to the toe portion of modified shoe 250 raises the toe and ball area of the wearer's foot by the thickness 266 of the external pad 260. Raising the toe and ball area of the wearer's foot, while maintaining the original configuration of the heel 220, reduces the angular slope of the shank 218 of the modified shoe 250. This reduction of the angular slope of the shank 218, in turn, redistributes the concentrated force of the wearer's weight over the length of the wearer's foot as depicted by arrows "B;" thereby, relieving a portion of the stress on the ball and toe area of the wearer's foot typified by the stress induced by the unmodified shoe 210 (see FIG. 7, arrows "A"). Other material properties of the external pad 260, such as, for example, its resilience, provide cushioning that absorb a portion of the impact force of the wearer's weight on the toe and ball area while walking.

Figure 9:
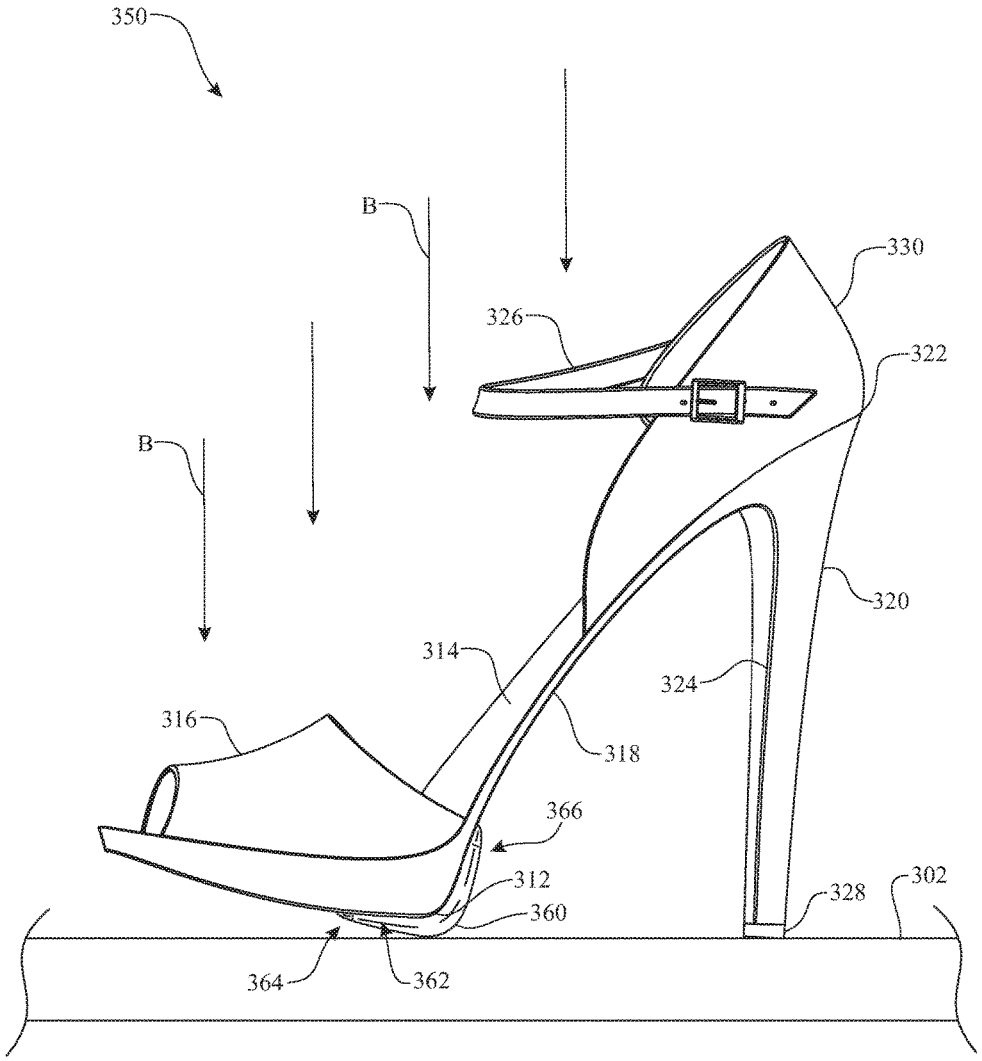
FIG. 9 presents a side elevation view of the modified woman's high heel shoe of FIG. 7 in an alternate implementation where the pad is affixed extending from the outsole to the shank, including the transition area therebetween.

Referring now to FIG. 9, in another implementation, a high-heeled shoe is modified by affixing an external pad 360 to the bottom of a transition area of the outsole 312, wherein the transition area is defined as an area extending from an area of the outsole 312 where the ball of the foot is supported, to the beginning of the shank 318. As clearly shown, the external pad 360 may have a profile incorporating a variable thickness that tapers from a first thickness proximate to a rear portion 366 of the external pad 360 to a reduced thickness proximate a forward portion 364 of the external pad 360. The perimeter edge of the external pad 360 and the lower pad surface of the external pad 360 are joined by a lower radial edge 362. The outsole 312 is cleaned of dust, dirt and other particulates that the outsole may have accumulated during prior wear. Once the outsole 312 has been cleaned, the surface can be abraded by known methods to expose a fresh outsole attachment layer. A curable adhesive may be applied to the exposed surface of the outsole 312 and to the top (or upper) surface of the external pad 360. The upper surface of the external pad 360 is then mated to an area of the aforementioned transition area. The adhesive is cured for a specified period of time, in accordance with common practice for the type of adhesive utilized. After the adhesive is cured, prior to securing the external pad 360 to the high heel shoe 310, the contour 364 is trimmed, using methods known in the shoe industry, to conform the external pad 360 to the outer contour of the outsole 312 to result in modified shoe 350.

As best illustrated in FIG. 9, during use the modified shoe 350, when worn by a user, is supported by a surface 302. The addition of the external pad 360 to the toe portion of modified shoe 350 raises the toe and ball area of the wearer's foot by a thickness 266 (see FIG. 3) of the external pad 360. Raising the toe and ball area of the wearer's foot, while maintaining the original configuration of the heel 320, reduces the angular slope of the shank 318 of the modified shoe 350. The reduction of the angular slope of the shank 318, in turn, redistributes the concentrated force of the wearer's weight along the length of the wearer's foot, as represented by arrows "B." In this manner, a portion of the stress on the ball and toe area of the wearer's foot is relieved. Furthermore, material properties of the external pad 360, such as the resilience, provide cushioning to absorb a portion of the impact force of the wearer's weight on the toe and ball area while walking.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method for modifying a high-heeled shoe to reduce an impact force on a wearer's foot, the method comprising the steps of:

providing a unitary resilient external pad for attachment to a transition area of an external sole of the high-heeled shoe, the resilient external pad having a geometry defined by a contiguous perimeter edge separating an upper resilient pad surface and an opposite lower resilient pad surface, the perimeter edge and the lower resilient pad surface joined by a lower radial edge portion, the resilient external pad having a variable thickness wherein the thickness of the resilient pad tapers from a first thickness proximate a rear portion thereof to a reduced resilient pad thickness proximate a forward portion thereof, and further wherein said lower surface has a generally convex contour which, in combination with said lower radial edge, functions to effect said reduced impact force on the wearer's foot while walking in said shoe;

cleaning the toe region of the shoe outsole;

applying a curable adhesive to at least one surface selected from the group consisting of the top surface of the external pad and the toe region outsole of the shoe;

affixing the top surface of the external pad to the shoe outsole;

curing the applied curable adhesive for a specified period of time corresponding to the type of curable adhesive that is applied; and trimming the outer contour of the external pad to conform to the outer contour of the outsole.

2. The method recited in claim 1 wherein the first thickness of the resilient external pad has a thickness within the range of one-quarter to two inches.

3. The method recited in claim 1 wherein the first thickness of the resilient external pad has a thickness of three-fourths inches.

4. The method recited in claim 1 wherein the external pad is constructed of one of the materials selected from the group consisting of rubber, high density foam, polymer, and gel.

5. The method recited in claim 1 wherein the external pad is constructed of a combination of at least two of the materials selected from the group consisting of rubber, high density foam, polymer, and gel.

6. The method recited in claim 1 wherein the upper surface of the external pad is substantially planar.

7. The method recited in claim 1 further comprising, after the cleaning step, the step of abrading the toe region of the shoe outsole.

8. The method recited in claim 1 wherein the step of applying further comprises the step of applying adhesive to the upper surface of the external pad and to the toe region outsole of the shoe.

9. A method for modifying a high-heeled shoe to reduce an impact force on a wearer's foot, the method comprising the steps of:

providing a unitary resilient external pad for attachment to a transition area of an external sole of the high-heeled shoe, the resilient external pad having a geometry defined by a contiguous perimeter edge separating an upper resilient pad surface and an opposite lower resilient pad surface, the perimeter edge and the lower resilient pad surface joined by a lower radial edge portion, the resilient external pad having a variable thickness wherein the thickness of the resilient pad tapers from a first thickness proximate a rear portion thereof to a reduced resilient pad thickness proximate a forward portion thereof, said first thickness is within the range of one-quarter to two inches and further wherein said lower surface has a generally convex contour which, in combination with said lower radial edge, functions to effect said reduced impact force on the wearer's foot while walking in said shoe;

cleaning the toe region of the shoe outsole;

applying a curable adhesive to the top surface of the external pad and to the toe region outsole of the shoe;

affixing the external pad to the toe region of the shoe outsole;

curing the applied curable adhesive for a specified period of time corresponding to the type of curable adhesive that is applied; and trimming the outer contour of the external pad to conform to the outer contour of the outsole.

10. The method recited in claim 9 wherein the first thickness of the resilient external pad has a thickness of three-quarters inches.

11. The method recited in claim 9 wherein the external pad is constructed of one of the materials selected from the group consisting of rubber, high density foam, polymer, and gel.

12. The method recited in claim 9 wherein the external pad is constructed of a combination of at least two of the materials selected from the group consisting of rubber, high density foam, polymer, and gel.

13. The method recited in claim 9 wherein the upper surface of the external pad is substantially planar.

14. A method for modifying a high-heeled shoe to reduce an impact force on a wearer's foot, the method comprising the steps of:

providing a unitary resilient external pad for attachment to a transition area of an external sole of the high-heeled shoe constructed of one of the materials selected from the group consisting of rubber, high density foam, polymer, and gel, the resilient external pad defined by a contiguous perimeter edge separating an upper resilient pad surface and an opposite lower resilient pad surface the perimeter edge and the lower resilient pad surface joined by a lower radial edge portion, the resilient external pad having a variable thickness wherein the thickness of the resilient pad tapers from a first thickness proximate a rear portion thereof to a reduced resilient pad thickness proximate a forward portion thereof, said first thickness is within the range of one-quarter inches to two inches, and further wherein said lower surface has a generally convex contour which, in combination with said lower radial edge, functions to effect said reduced impact force on the wearer's foot while walking in said shoe;

cleaning the toe region of the shoe outsole;

abrading the toe region of the shoe outsole;

applying a curable adhesive to at least one surface selected from the group consisting of the top surface of the external pad and the toe region outsole of the shoe;

affixing the top surface of the external pad to the shoe outsole;

curing the applied curable adhesive for a specified period of time corresponding to the type of curable adhesive that is applied; and trimming the outer contour of the external pad to conform to the outer contour of the outsole.

15. The method recited in claim 14 wherein the first thickness of the resilient external pad has a thickness of three-fourths inches.

16. The method recited in claim 14 wherein the upper surface of the external pad is substantially planar.

17. The method recited in claim 14 wherein the step of applying further comprises applying adhesive to the upper surface of the external pad and the toe region outsole of the shoe.

* * * * *